US008926269B2

(12) United States Patent
Dillard et al.

(10) Patent No.: US 8,926,269 B2
(45) Date of Patent: Jan. 6, 2015

(54) STEPPED, CONICAL HONEYCOMB SEAL CARRIER

(75) Inventors: Daniel Jackson Dillard, Greenville, SC (US); Gregory Thomas Foster, Greer, SC (US); Niranjan Gokuldas Pai, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 76 days.

(21) Appl. No.: 13/225,895

(22) Filed: Sep. 6, 2011

(65) Prior Publication Data

US 2013/0058764 A1 Mar. 7, 2013

(51) Int. Cl.
*F01D 11/02* (2006.01)
*F01D 11/00* (2006.01)

(52) U.S. Cl.
CPC ..... *F01D 11/001* (2013.01)
USPC ..... 415/171.1; 416/174

(58) Field of Classification Search
USPC ..... 415/173.4, 173.5, 174.4, 171.1; 416/174
See application file for complete search history.

(56) References Cited

U.S. PATENT DOCUMENTS 3,514,112 A * 5/1970 Pettengill, Jr. ..... 277/303
3,589,475 A * 6/1971 Alford ..... 188/381
3,986,720 A * 10/1976 Knudsen et al. ..... 277/411
4,213,296 A * 7/1980 Schwarz ..... 60/786
4,257,222 A * 3/1981 Schwarz ..... 60/782
4,314,792 A * 2/1982 Chaplin ..... 415/116
4,466,239 A * 8/1984 Napoli et al. ..... 60/782
5,044,881 A * 9/1991 Dodd et al. ..... 415/173.3
5,096,376 A * 3/1992 Mason et al. ..... 415/173.5
5,152,666 A * 10/1992 Stripinis et al. ..... 415/178
5,215,435 A 6/1993 Webb et al.
5,236,302 A 8/1993 Weisgerber et al.
5,346,362 A * 9/1994 Bonner et al. ..... 415/191
5,462,403 A * 10/1995 Pannone ..... 415/173.1
5,950,308 A 9/1999 Koff et al.
7,291,946 B2 * 11/2007 Clouse et al. ..... 310/51
7,334,983 B2 2/2008 Alvanos et al.
8,182,210 B2 * 5/2012 Khanin et al. ..... 415/173.1
2006/0275107 A1 12/2006 Alvanos et al.
2007/0059158 A1 3/2007 Alvanos et al.
2009/0142189 A1 6/2009 Kovac et al.

OTHER PUBLICATIONS

Search Report and Written Opinion from EP Application No. 12182825.5 dated Oct. 30, 2012.

* cited by examiner

*Primary Examiner* — Edward Look
*Assistant Examiner* — Sean J Younger
(74) *Attorney, Agent, or Firm* — Nixon & Vanderhye P.C.

(57) ABSTRACT

A seal carrier for a seal used between rotating and non-rotating components includes an arcuate sheet metal seal carrier body formed to include a stepped, conical configuration wherein an inner diameter at a forward end is larger than the diameter at an aft end, with plural stepped sections defined by alternating radial and axial portions between the forward end and the aft end. Each axial portion is adapted to carry a seal element, preferably a honeycomb seal. Mounting flanges are provided at the forward end and the aft end of the arcuate sheet metal seal carrier body to enable attachment to the non-rotating component.

19 Claims, 5 Drawing Sheets

STEPPED, CONICAL HONEYCOMB SEAL CARRIER

BACKGROUND

The present invention relates generally to seals used in gas turbine engines and, more particularly, to an interstage seal configuration used to reduce secondary flows between rotor wheel-space cavities.

It is well known that turbines extract energy from a hot gas stream as it impinges on the turbine blades mounted on a rotor wheel or disk fixed on a shaft or rotor of an associated rotary apparatus such as a generator. The blades are in the form of airfoils manufactured from materials capable of withstanding extreme temperatures. The mounting and shank portions of the blades are typically made of the same material, but the rotor disk posts between the mounting portions (or dovetails) are made of less capable material. For this reason, it is important to protect the disk posts from the direct impact of the high temperatures of the hot gas stream. Therefore, the blades and adjacent vane elements of the turbine are provided with platforms which axially combine to define a circumferential boundary, thus isolating the radially inner mounting or shank portions from the hot gas stream.

Protection against high temperatures is equally important throughout the rotor cavity. However, it becomes even more pronounced in the interstage region of the high pressure portion of turbine where the boundary of the expanding hot gases comes close to temperature sensitive areas of the rotor cavity, such as the forward and aft cavities bounded by the disk post for the stage one blade wheel, the platform for the stage two stationary nozzle assembly, and by the disc post of the stage two blade wheel.

According to present practice, labyrinth-type seals are often used between the forward and aft cavities. Such seals are well known in the art and include a plurality of circumferential teeth which are contiguous with a circumferential sealing surface made from a high temperature resistant abradable material in, for example, honeycomb form, providing the sealing surfaces with which the labyrinth teeth contact and, due to the deformability of the honeycomb material, the sealing surfaces becomes deformed without injury to the teeth, thereby establishing a minimum clearance required under operating conditions. See, for example, U.S. Pat. No. 5,215,435. Such seals also prevent performance loss due to flow bypassing the stationary airfoils by flowing through the wheel space instead.

Traditional diaphragm and honeycomb carrier designs have a substantially constant inner diameter which requires more radial space for packaging, since the flowpath outboard of the seal is conical in shape. In addition, such designs also involve more intersegment leakage because there is a larger radial gap between the seal teeth on the rotor and the stationary nozzle due to the relatively thick carrier and larger radial height.

Alternatively, some designs have used a cylindrical, sheet metal carrier of uniform diameter, where steps are machined into the honeycomb material.

The problem here is that such machining without damaging the honeycomb material is difficult and, therefore, more expensive and time-consuming methods must be used.

There remains a need therefore, for an interstage seal of simpler construction that also provides improved clearances and sealing over the prior design.

BRIEF SUMMARY OF THE INVENTION

Accordingly, in one exemplary but nonlimiting embodiment, there is provided a seal carrier for a seal used between rotating and non-rotating components comprising an arcuate sheet metal seal carrier body formed to include a stepped, conical configuration wherein an inner diameter at one end is larger than a diameter at an opposite end, with plural stepped sections defined by alternating radial and axial portions between the one end and the opposite end, each axial portion adapted to carry a seal element; and wherein mounting flanges are provided at the one end and the opposite end of the arcuate sheet metal seal carrier body.

In another exemplary but nonlimiting embodiment, there is provided an annular seal for use between rotating and non-rotating components of a gas turbine comprising an annular sheet metal seal carrier body formed to include a stepped, conical configuration wherein a diameter at a forward end is larger than the diameter at an aft end, with plural stepped sections defined by alternating radial and axial portions between said forward end and said aft end, each axial portion carrying a discrete seal element and wherein an outer surface of the annular sheet metal seal carrier body is provided with axially extending ribs, spaced circumferentially about the annular sheet metal seal carrier body.

In still another exemplary but nonlimiting embodiment, there is provided an annular seal for use between rotating and non-rotating components of a gas turbine comprising an annular sheet metal seal carrier body comprised of multiple arcuate segments, each segment formed to include a stepped, conical configuration wherein a diameter at a forward end is larger than the diameter at an aft end, with plural stepped sections defined by alternating radial and axial portions between the forward end and the aft end, each axial portion carrying a discrete honeycomb seal element; and wherein an outer surface of said annular sheet metal seal carrier body is provided with axially extending ribs spaced circumferentially about said annular sheet metal seal carrier body.

The invention will now be described in detail in connection with the drawings identified below.

DETAILED DESCRIPTION OF THE INVENTION

Figure 1:
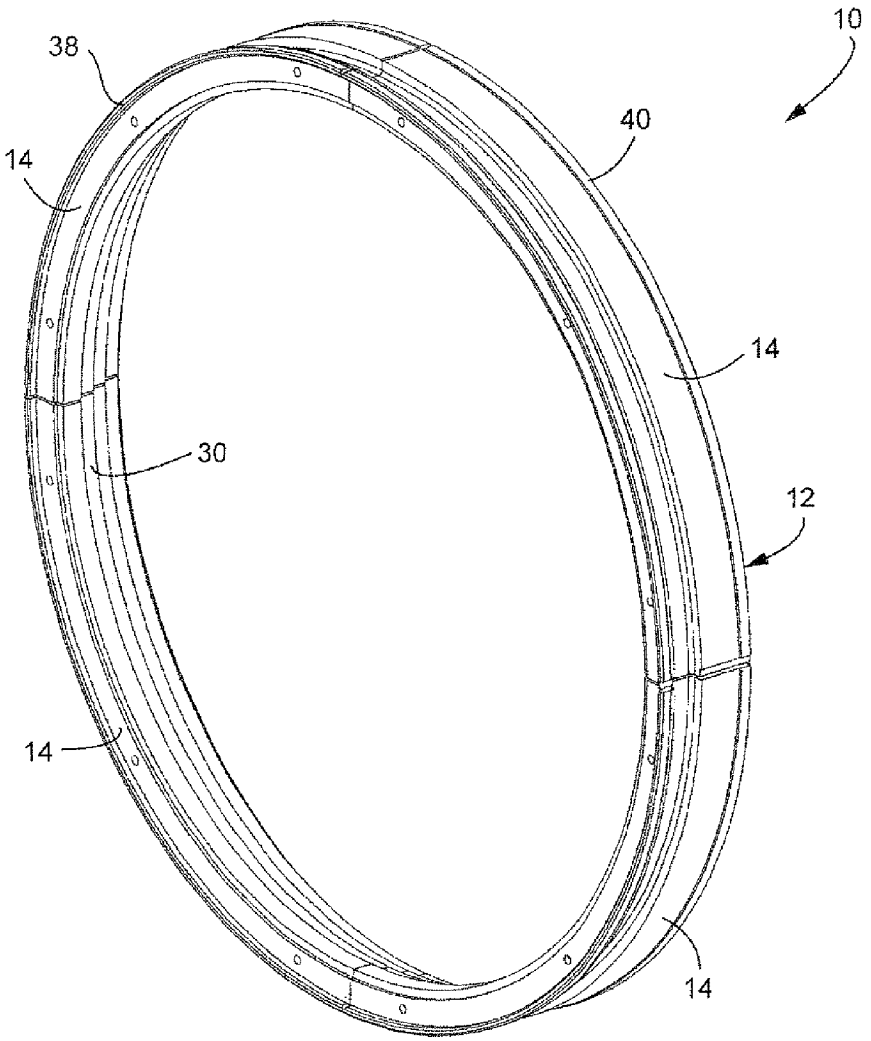
FIG. 1 (PRIOR ART)
FIG. 1 is a perspective view of a conventional seal carrier.

With reference initially to FIG. 1, a known annular seal carrier 10 is comprised of a seal carrier body 12 that is provided in the form of four substantially identical arcuate segments 14. When assembled in, for example, a stationary component such as a turbine nozzle inner shroud (not shown in FIG. 1), the individual segments 14 are engaged in abutting relationship, and form the annular seal carrier body 12. Typically, the carrier body is cast or a machined forging.

Figure 2:
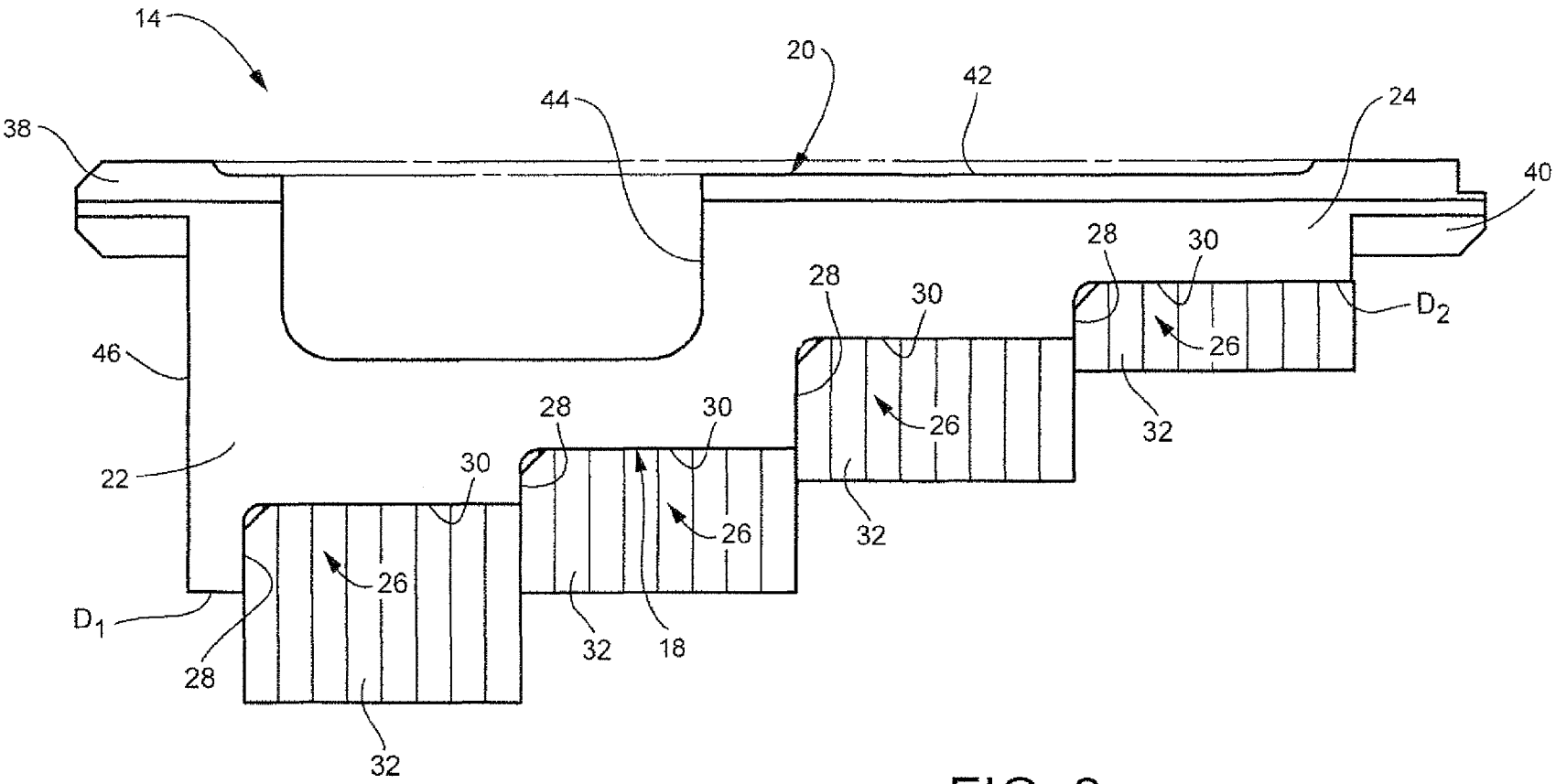
FIG. 2 (PRIOR ART)
FIG. 2 is a partial end view of one segment of the seal carrier shown in FIG. 1, with honeycomb seal elements in place on the inside surfaces of the carrier.

FIG. 2 shows in greater detail an end profile of the arcuate segments 14 of the relatively thick carrier body 12, including the radially inner and outer surfaces 18, 20, respectively. The inner surface 18 is cast or machined to include a stepped, conical configuration with an inner diameter D1 at a forward end 22 that is smaller than the inner diameter D2 at an opposite aft end 24, with plural stepped sections 26 between the forward and aft ends. The stepped sections 26 are each defined by alternating radial shoulders 28 and axial portions 30 between the forward end and the aft end. Each axial portion 30 carries a discrete seal element 32, which in the exemplary embodiments described herein, may be an otherwise conventional honeycomb seal elements that may engage substantially the full length of the respective axial portions 30, and substantially the full radial length of the respective radial shoulders 28.

The forward and aft ends 22, 24 are provided with axially-extending mounting flanges 38, 40 that enable the segments to be slidably inserted within opposed grooves (not shown) in the stationary component.

The outer surface 20 of the seal carrier body, between the mounting flanges 38, 40, is formed with a substantially uniform diameter surface portion 42 with an annular groove 44 located adjacent the mounting flange 38 at the forward end 22. A forward edge 46 extends radially between the flange 38 and a location mid-way along the radial length of the forward-most honeycomb seal element 32. As will be appreciated, this design requires more radial space for packaging, because it does not follow the contour of the flowpath outboard of the seal.

Figure 3:
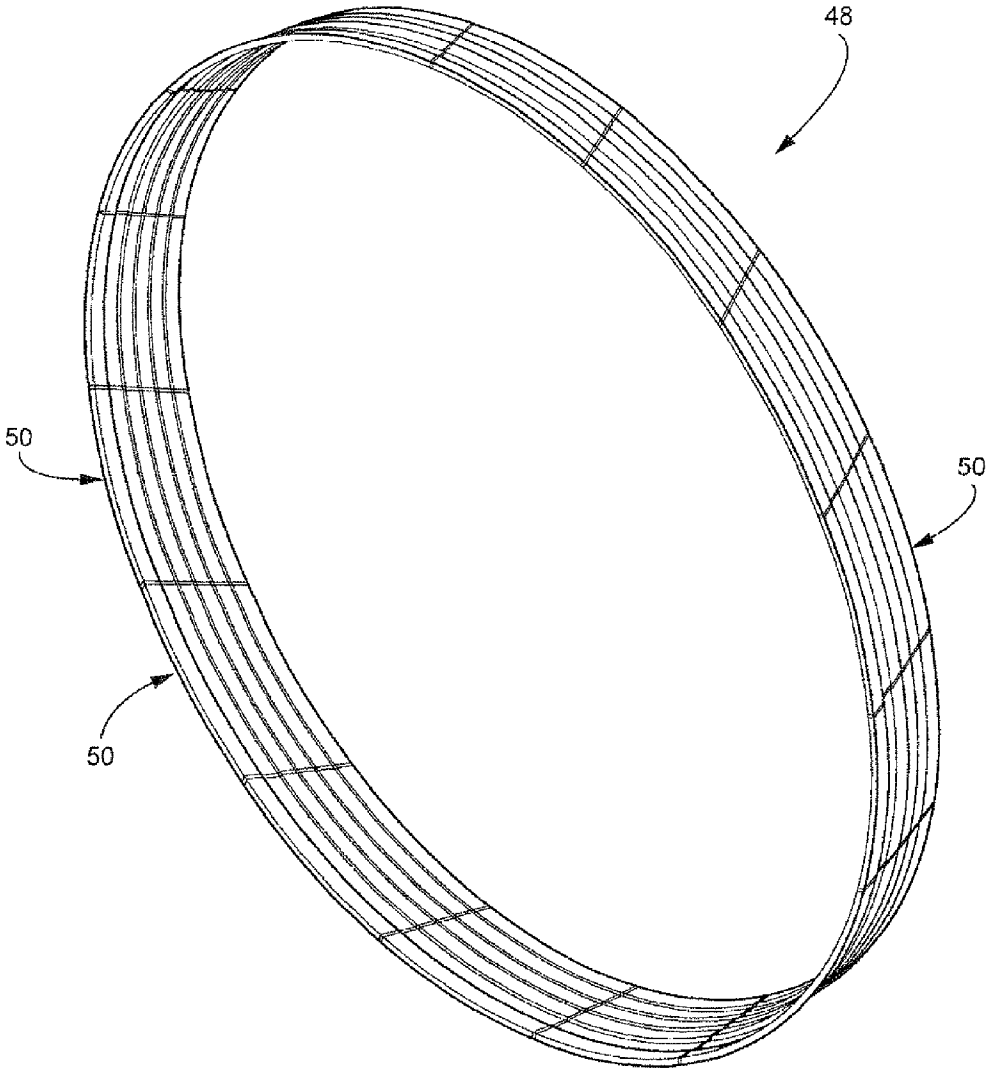
FIG. 3 is a perspective view of a seal carrier in accordance with a first exemplary but nonlimiting embodiment of the invention.

FIG. 3 illustrates a formed sheet metal seal carrier body 48 in accordance with a first exemplary but nonlimiting embodiment of the invention. The annular seal carrier body 48 is comprised of several arcuate segments 50 that are installed individually on, for example, a stationary nozzle as described further below. The seal carrier body 48 is comprised of relatively thin sheet metal that is readily bent or pressed to form the stepped, conical cross-sectional shape best seen in FIG. 4. Thus, each segment 50 is shaped such that both the inside and outside surfaces 52, 54 of the seal carrier body 48 (and therefore each segment 50) have identical stepped, conical configurations extending between the forward end 58 and the aft end 60. Thus, the seal carrier body tapers substantially uniformly in a stepped manner, from the forward end 58 to the aft end 60. In this embodiment, the adjacent stepped sections 62 have axially-extending portions 64 and radial shoulders 66, where both the axial length dimensions and the radial length dimensions of the stepped sections may vary between the forward and aft ends of the carrier body. The honeycomb seal elements 68 on the inside surface 52 are shown to have substantially identical axial and radial length dimensions, although this need not be the case. In addition, the radial height of shoulders 66 and axial length of axial portions 64 may also vary.

Reinforcement of the segments 50 of the seal carrier body 48 is provided by a plurality of stiffening features, for example, axially-aligned gussets or ribs 70 extending along the outside surface 54 of each of the axially-extending portions 64 and engaged by the respective radial shoulders 66. It will be appreciated that two or more similar arrangements of axially-oriented reinforcement ribs 70 may be found at circumferentially spaced locations on each seal carrier segment. The ribs taper substantially uniformly from the forward end to the aft end, consistent with the stepped taper of the seal carrier body.

Mounting flanges 74, 76 are formed at the forward and aft ends of the carrier body, the flanges bent back approximately 180° and received in grooves 78, 80 in inner shroud 82 of the stationary nozzle 84. This arrangement permits each segment 50 to be installed in the grooves 78, 80 of an associated nozzle segment, after which the nozzle segments are installed in sequence on the turbine case (not shown) until the full annular seal carrier body of FIG. 3 is formed. In those instances where there are fewer seal carriers than nozzle segments, the nozzle segments would be installed first and then the seal carriers would be installed in sequence.

Figure 4:
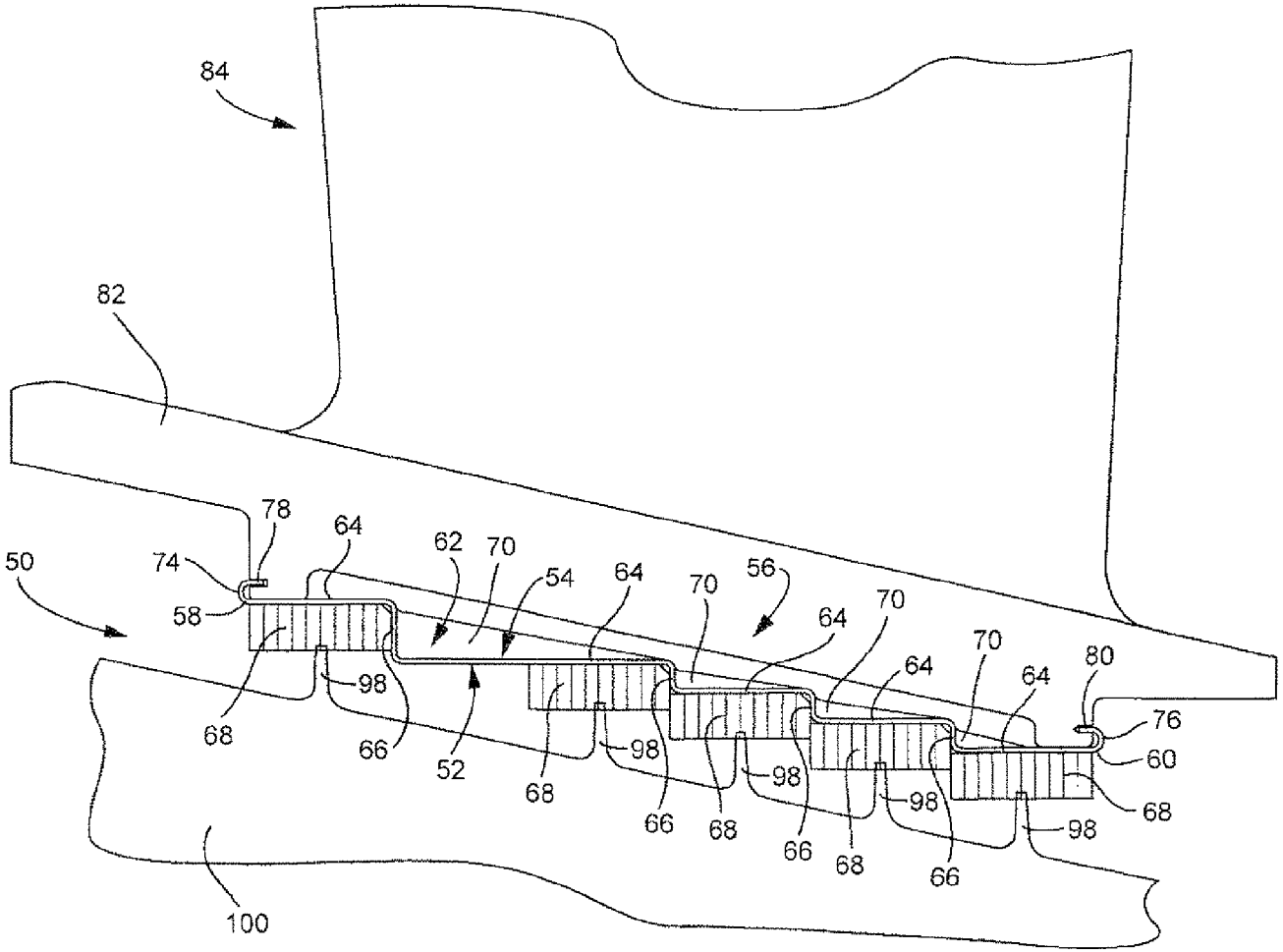
FIG. 4 is a simplified cross-section of a seal carrier as shown in FIG. 3 but with reinforcing ribs added.
Figure 5:
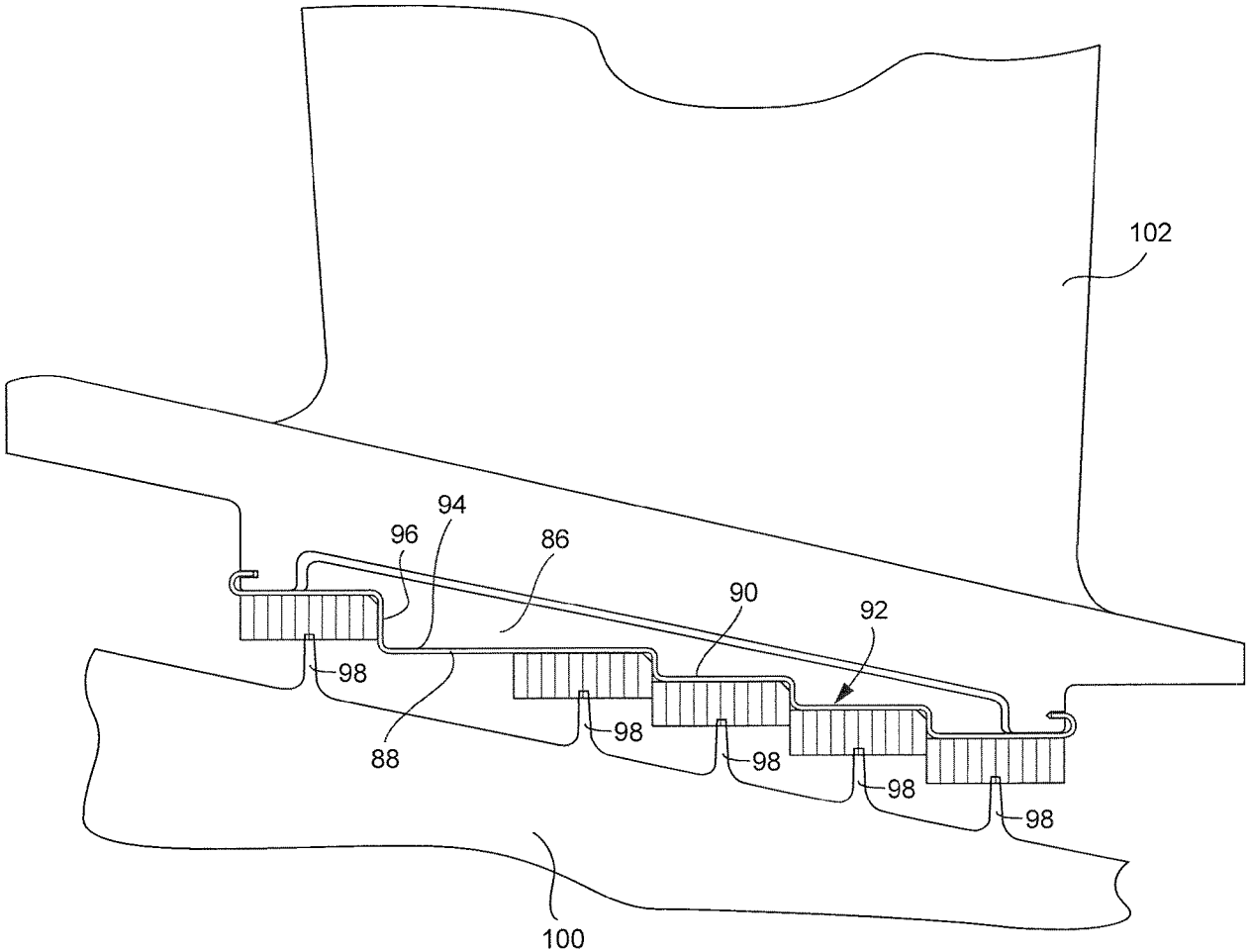
FIG. 5 is a cross-section similar to FIG. 4 but showing an alternative reinforcing rib configuration.

FIG. 5 illustrates another exemplary but nonlimiting embodiment similar to that shown in FIG. 4 but where a single reinforcement rib 86 extends along substantially the entire length of the seal carrier body 92. Thus, the inside surface 88 of the rib conforms to the outside surface 90 of the carrier body 92, including axial portions 94 and radial shoulders 96. Here again, one or more ribs 86 are provided for each segment of the carrier body 92 so that the ribs are circumferentially-spaced about the seal carrier body.

The stiffening ribs as described above enable the use of sheet metal for the carrier. It will be appreciated that circumferentially oriented ribs could also be used to provide a measure of circumferential stiffness. In addition, other stiffening features could be embossed in the sheet metal in combination with or as alternatives to the stiffening ribs.

It will be appreciated that the relative dimensions, including radial height and axial length of the seal engaging surfaces of the carrier body may vary for different applications. For example, the dimensions will depend largely on the location of the opposed seal teeth 98 on the opposed rotating component (e.g. rotor 100) relative to the non-rotating component (e.g., nozzle 102). Similarly, the carrier body is not limited to use with honeycomb seals, but may also support other known seal elements. The number of arcuate segments in each annular seal carrier body may vary from two to as many as about seventy, and preferably between sixteen and twenty-four.

The sheet metal seal carrier described herein has packaging and sealing benefits, and in addition, the seal carrier is less costly versus machined castings/forgings typically used for such carriers.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A seal and seal carrier for use between a non-rotating nozzle and a rotating component of a turbine, the seal and seal carrier comprising:

an arcuate sheet metal seal carrier body configured to attached to the nozzle, the sheet metal carrier body includes a stepped, conical shape in a region between opposite ends, wherein a diameter at one of said opposite ends is larger than a diameter at the other of said opposite ends, inwardly and outwardly facing surfaces of said arcuate sheet metal seal carrier body within said region being identical, said region formed with plural stepped sections defined by alternating radial and axial portions; and a seal element mounted on each axial portion, each seal having a substantially constant radial height;

wherein mounting flanges are provided at said opposite ends of said arcuate sheet metal seal carrier body; and wherein said sheet metal seal carrier body is formed with one or more axially-extending stiffening ribs on said outwardly facing surfaces and the axially extending ribs project radially outwardly toward the nozzle and from the outer surface of the arcuate sheet metal steel carrier body, wherein the ribs each include a radial edge abutting a radially inwardly extending surface of one of the stepped sections and an axial edge abutting an axially extending surface of an adjacent one of the stepped sections.

2. The seal carrier of claim 1 wherein said axially-extending ribs are spaced circumferentially about said arcuate sheet metal carrier body, and tapered uniformly between said mounting flanges.

3. The seal carrier of claim 1 wherein said axially-extending ribs are spaced circumferentially about said arcuate sheet metal seal carrier body and formed by discrete rib portions extending along each of said axial portions.

4. The seal carrier of claim 1 wherein said axial portions are formed with differential axial lengths.

5. The seal carrier of claim 1 wherein said radial portions are formed with differential radial heights.

6. The seal carrier of claim 4 wherein said radial portions are formed with differential radial heights.

7. The seal carrier of claim 1 wherein said arcuate sheet metal seal carrier body is comprised of between 2 and about 70 arcuate segments that, together, comprise a 360 degree, annular carrier body.

8. An annular seal for use between a non-rotating nozzle and a rotating component of a gas turbine comprising:

an annular sheet metal seal carrier body configured to cover a radially inward surface of the nozzle and including a stepped, conical configuration wherein a diameter at a forward end is larger than the diameter at an aft end, with plural stepped sections defined by alternating radial and axial portions between said forward end and said aft end, each axial portion carrying a discrete seal element of substantially constant diameter; and wherein an outer surface of said annular sheet metal seal carrier body is provided with axially extending ribs, spaced circumferentially about said annular sheet metal seal carrier body and the axially extending ribs project radially outwardly towards the inward surface of the nozzle and from the outer surface of the annular sheet metal seal carrier body, wherein the ribs each include a radial edge abutting a radially inwardly extending surface of one of the stepped sections and an axially extending edge abutting an axially extending surface of an adjacent one of the stepped sections.

9. The annular seal of claim 8 wherein said discrete seal element comprises a honeycomb seal.

10. The annular seal of claim 8 wherein said axially extending ribs taper substantially uniformly from said forward end to said aft end, between said mounting flanges.

11. The annular seal of claim 8 wherein said axially extending ribs are formed by discrete rib portions extending along each of said axial portions.

12. The annular seal of claim 8 wherein said axial portions are formed with differential axial lengths.

13. The annular seal of claim 8 wherein said radial portions are formed with differential radial heights.

14. The annular seal of claim 8 wherein said annular carrier body is comprised of between 2 and about 70 arcuate segments that, together, comprise a 360 degree, annular carrier body.

15. An annular seal for use between a non-rotating nozzle and a rotating component of a gas turbine comprising:

an annular, sheet metal seal carrier body configured to seat on the nozzle and comprised of multiple arcuate segments, each segment including a stepped, conical configuration wherein a diameter at a forward end is larger than the diameter at an aft end, with plural stepped sections defined by alternating radial and axial portions between said forward end and said aft end, each axial portion carrying a discrete honeycomb seal element of substantially constant diameter; and wherein an outer surface of said annular sheet metal seal carrier body is provided with axially extending ribs, spaced circumferentially about said annular sheet metal seal carrier body and the axially extending ribs project radially outwardly towards the nozzle and from the outer surface of the annular sheet metal seal carrier body, wherein the ribs each include a radial edge abutting a radially inwardly extending surface of one of the plural stepped sections and an axially extending edge abutting an axially extending surface of an adjacent one of the plural stepped sections.

16. The annular seal of claim 15, wherein said axially extending ribs taper substantially uniformly from said forward end to said aft end.

17. The annular seal of claim 15 wherein said axially extending ribs are formed by discrete rib portions extending along each of said axial portions.

18. The annular seal of claim 15 wherein mounting flanges are provided at said forward end and said aft end, respectively, adapted to attach said annular seal to the non-rotating component.

19. The annular seal of claim 15 wherein said rotating component comprises a gas turbine rotor provided with labyrinth seal teeth adapted to engage said honeycomb seal elements.

* * * * *